United States Patent [19]

Frentzel-Beyme

[11] Patent Number: 4,469,290

[45] Date of Patent: Sep. 4, 1984

[54] THREAD GUIDE FOR COAXIALLY MOUNTED BOBBINS

[75] Inventor: Johannes Frentzel-Beyme, Monchengladbach, Fed. Rep. of Germany

[73] Assignee: Palitex Project-Company GmbH, Krefeld, Fed. Rep. of Germany

[21] Appl. No.: 402,611

[22] Filed: Jul. 28, 1982 (Under 37 CFR 1.47)

[30] Foreign Application Priority Data

Aug. 1, 1981 [DE] Fed. Rep. of Germany ..... 3130615

[51] Int. Cl.[3] ..... B65H 49/00; B65H 57/20; D01H 7/86; D01H 13/04

[52] U.S. Cl. ..... 242/128; 57/58.52; 57/58.83; 57/59; 57/352; 242/157 R

[58] Field of Search ..... 57/59, 58.49, 58.52, 57/58.83, 58.86, 352; 242/128, 157 R, 157 C

[56] References Cited

U.S. PATENT DOCUMENTS

| | | | |
|---|---|---|---|
| 3,022,623 | 2/1962 | Lenk | 57/58.83 |
| 3,044,246 | 7/1962 | Schippers | 57/58.83 X |
| 3,119,224 | 1/1964 | Kocks | 57/58.83 X |

*Primary Examiner*—John Petrakes

[57] ABSTRACT

A thread guide for drawing threads (3',4') overhead from two yarn bobbins (3,4) disposed coaxially one above the other comprising separate thread guide flyer arrangements (5,12) mounted by means of respective bearing bushes (6,13) provided for each yarn bobbin. The thread guide flyer arrangement (5) provided for the lower yarn bobbin (3) is mounted between the two yarn bobbins. The second thread guide flyer arrangement (12), which can be associated with the upper yarn bobbin, is also mounted between the two yarn bobbins such that the two thread guide flyer arrangements keep one another under control for the purpose of rendering their circumferential speeds uniform.

7 Claims, 2 Drawing Figures

THREAD GUIDE FOR COAXIALLY MOUNTED BOBBINS

BACKGROUND AND OBJECTIVES OF THE INVENTION

The invention relates to a thread guide for drawing threads overhead from two yarn bobbins disposed coaxially one above the other, a separate thread guide flyer arrangement journalled by means of a respective bearing bushing being provided for each yarn bobbin.

In a thread guide of this kind which is described in German Patent Specification (Auslegeschrift) No. 11 59 826 and which is provided for a two-for-one twisting spindle, the thread guide flyer arrangement associated with the lower yarn bobbin is mounted on the spindle axis between the two yarn bobbins, while the second thread guide flyer arrangement provided for the upper yarn bobbin is also rotatably mounted on the axis of the spindle but above the second bobbin. Each of the two thread guide flyer arrangements is provided with a first thread-guide eye in the region of the periphery of the associated yarn bobbin, and with a further thread-guide eye substantially in the region of the top edge of the upper yarn bobbin, the thread-guide eyes associated with the lower yarn bobbin being located radially beyond the thread-guide eyes associated with the upper yarn bobbin.

In the ideal case when drawing thread from the two yarn bobbins, an arrangement of this kind ensures that the threads drawn from the two yarn bobbins are properly lifted from the outer surface of the bobbins on the one hand and, on the other hand, do not interfere with one another.

Thus, the eyes of the two thread guide flyer arrangements are disposed such that the threads are lifted from the bobbins disposed one above the other without the threads coming into contact with the sides of the bobbins during the course of feeding the threads to a processing apparatus.

A non-uniform rotational speed of the thread guide flyer occurs when drawing threads overhead from conical cross-wound bobbins. One cause of this is the difference in circumference between the smaller diameter at the top of the creel bobbin and the larger diameter at the bottom of the creel bobbin, it having to be taken into account that the conical shape of the bobbin is necessary in order to draw off the thread overhead, so that the thread can more readily roll on the circumference of the bobbin. A further cause of irregular running of the thread guide flyer is the crossing of the threads which is deposited in an irregularly wound manner due, in most cases, to trouble in a winder arranged in advance of the thread guide flyer arrangement. Rotation of the thread guide flyer is also affected by the snagging of the thread on the periphery of the creel bobbin, which occurs in most cases and which greatly obstructs free rotation of a thread guide flyer.

As a result of the specified causes of irregular rotation of the thread guide flyer, decelerative and accelerative moments are imparted to the thread guide flyer. These forces are effective for varying periods of time according to the mass of the thread guide flyer. Threads which are lifted from the periphery of a cross-wound bobbin by the known thread guide flyer arrangements are never uniformly tensioned and, as a result of this, run with differing tension into a thread processing device disposed beyond the thread guide flyer arrangement. As a result of, for example, greater spinning twist, a piece of thread under lower tension has a tendency immediately to form loops which either directly hinder further processing or which lead to a reduction in the quality of the material during further processing.

An object of the invention is to design a thread guide of the kind described initially, such that uniformity of the rotational speeds of the thread guide flyers or of the pigtail flyer arrangements for the two yarn bobbins (creel bobbins) disposed coaxially one above the other is obtained or ensured when the threads are being drawn off overhead.

A thread guide in accordance with the invention for drawing threads overhead from two yarn bobbins disposed coaxially one above the other comprises a separate thread guide flyer arrangement mounted by means of a respective bearing bushing for each yarn bobbin, the first thread guide flyer arrangement provided for the lower yarn bobbin being mounted between the two yarn bobbins, and the second thread guide flyer arrangement associated with the upper yarn bobbin being also mounted between the two yarn bobbins and in a manner which influences the bearing bushing of the first thread guide flyer arrangement.

In this manner, interaction between the rotational speeds of the two thread guide flyer arrangements is produced, that is to say, the rotational speed of one thread guide flyer arrangement affects the rotational speed of the other thread guide flyer arrangement. In order to utilize the positive effect of a thread guide of this kind to an optimum extent, the two yarn bobbins are mounted such that the two thread guide flyer arrangements rotate in opposite directions when the thread is being drawn off. If, in an arrangement of this kind, one of the two thread guide flyer arrangements seeks to run at a higher speed as a result of the negative causes or influences described above, it is rotated back relatively by the second thread guide flyer arrangement by frictional forces, that it to say, it is prevented from running at a higher speed. As a result of this, the thread guided by means of a thread guide flyer arrangement of this kind cannot become loose or slack and tend to form snarls. The thread always remains taut, since, with respect to the rotational speed, the two thread guide flyer arrangements mutually influence one another or keep one another under control.

The thread guide is accordance with the invention can be used wherever thread is simultaneously drawn off along the common axis of a plurality of yarn bobbins which are disposed coaxially one above the other.

Preferably, the bearing bushings of the two thread guide flyer arrangements are in sliding frictional contact with one another. The bearing bushings can be in the form of simple bearing rings which are mounted one above the other, or in the form of cylindrical bushings which are inserted one within the other and which, if necessary, can also be provided with annular flanges formed thereon.

Preferably, each thread guide flyer arrangement has a substantially radially directed thread guide flyer arm to the outer end of which is connected an axially directed thread guide flyer bar which is provided with at least one thread-guide eye. Preferably, a respective thread-guide eye can be disposed in the region of the periphery of the associated yarn bobbin, and a further thread-guide eye can be disposed substantially in the region of the top edge of the upper yarn bobbin.

BRIEF DESCRIPTION OF DRAWINGS

The invention will be further described hereinafter, by way of example, with reference to the accompanying drawings, in which.

DETAILED DESCRIPTION OF PREFERRED EMBODIMENTS OF THE INVENTION

Figure 1:
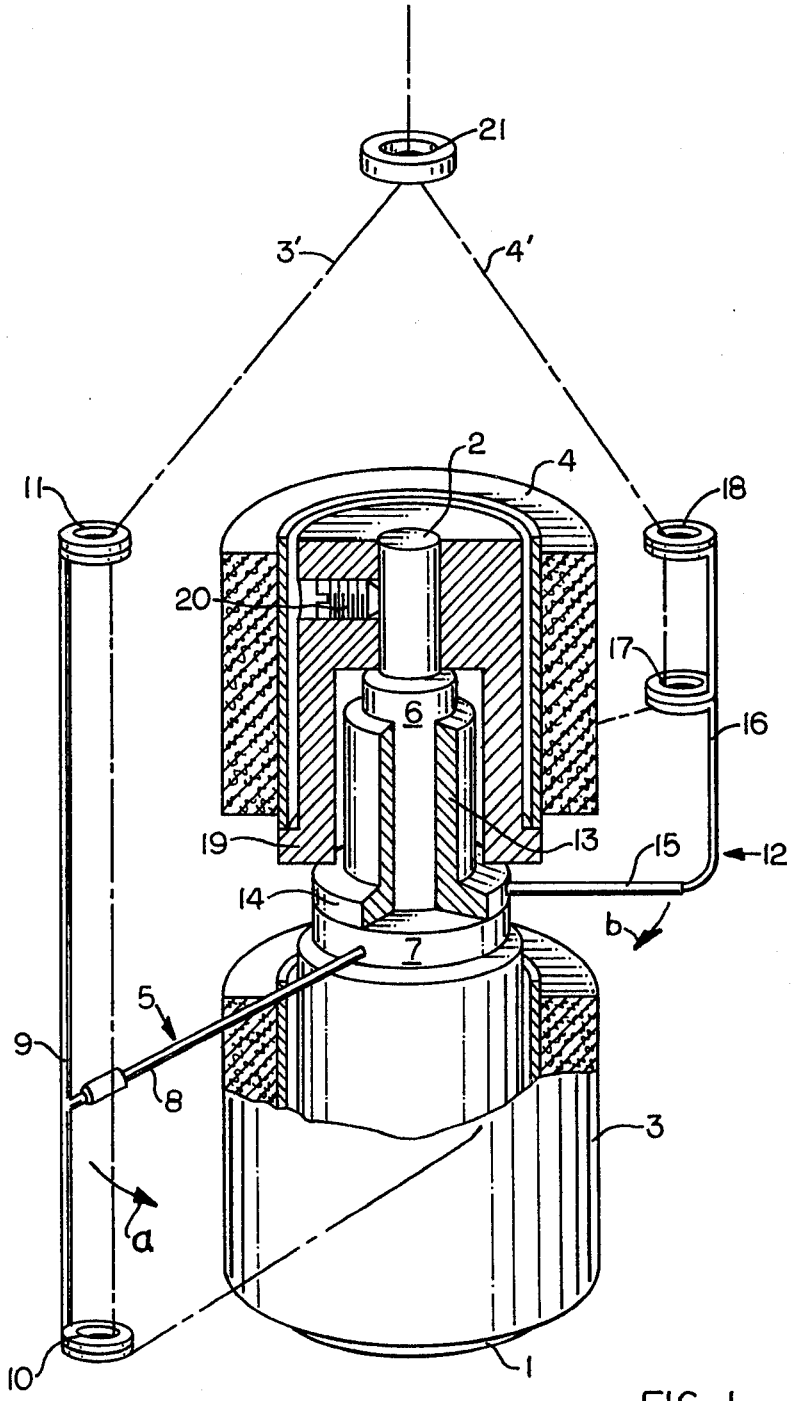
FIG. 1 is a diagrammatic illustration of a thread guide in accordance with the invention in the event of the drawing-off of two individual threads overhead through a common thread-guide eye from two singly wound cross-wound bobbins which are disposed one above the other.

FIG. 1 shows a bobbin carrier 1 having a bobbin mounting spindle 2. These parts form a unit. The bobbin carrier 1 serves to receive two yarn bobbins 3 and 4 which are disposed coaxially one above the other. The lower yarn bobbin 3 has an associated first thread guide flyer arrangement 5 which serves to apply a drag force on the yarn. The thread guide flyer arrangement 5 includes a bearing bushing 6 mounted on the bobbin mounting of spindle 2 and having an integral annular flange 7 to which is secured a radially directed thread guide flyer arm 8 whose outer end carries an upwardly and downwardly directed thread guide flyer bar 9. Thread-guide eyes 10 and 11 are mounted on the outer ends of the thread guide flyer bar 9. The thread-guide eyes 10 and 11 are disposed such that, during operation, the lower thread-guide eye is located substantially in the region of the periphery of the lower yarn bobbin 3, while the upper thread-guide eye 11 is located in the region of the top edge of the upper yarn bobbin 4. The annular flange 7 rests on a cylindrical body which is either mounted on the bobbin mounting spindle or forms an integrated component of the unit comprising the bobbin carrier 1 and the bobbin mounting spindle 2.

The second thread guide flyer arrangement 12 is supported on the annular flange 7 of the first or lower thread guide flyer arrangement 5 and includes a bearing bushing 13 having an integral annular flange 14 to which is secured a radially directed thread guide flyer arm 15 whose outer end carries an upwardly directed pigtail flyer bar 16 whose central region is provided with a first thread-guide eye 17 and whose top end is provided with a second thread-guide eye 18. In this second pigtail flyer arrangement 12, the lower thread-guide eye 17 is also located in the region of the periphery of the respective bobbin 4, and the upper thread-guide eye 18 is located in the region of the top edge of the yarn bobbin 4.

The thread guide flyer arm 8 of the lower pigtail flyer arrangement 5 is longer than the thread guide flyer arm 15 of the upper thread guide flyer arrangement 12, so that the two pigtail flyer arrangements can rotate about the bobbin carrier and the mounted yarn bobbins without obstruction one another.

The upper yarn bobbin 4 is otherwise carried by a bobbin holder 19 which is not in contact with the upper thread guide flyer arrangement 12 and which is fixed on the bobbin mounting spindle 2 by means of, for example, a grub screw 20.

The yarn bobbins 3 and 4 wound as cross-wound bobbins, are disposed one above the other and wound such that the thread runs from one yarn bobbin in one direction (a direction) and from the other yarn bobbin in the other direction (b direction). The threads 3' and 4' coming from the yarn bobbins 3 and 4 respectively run through the respective associated eyes 10,11 on the one hand and 17,18 on the other hand and are united in a common upper fixed eye 21 and commonly drawn off to a processing location of any optional type. During drawing-off of the threads, and as a result of the different ways in which the two cross-wound bobbins are wound, and as a result of the opposing mounting of the bobbins, the two thread guide flyer arrangements 5 and 12 rotate in opposite directions, the thread guide flyer arrangement 5 rotating in, for example, the direction of the arrow a, and the thread guide flyer arrangement 12 rotating in the direction of the arrow b. As a result of this rotation in opposite directions, the two thread guide flyer arrangements 5 and 12 are mutually influenced to affect the prevailing rotational speeds.

Figure 2:
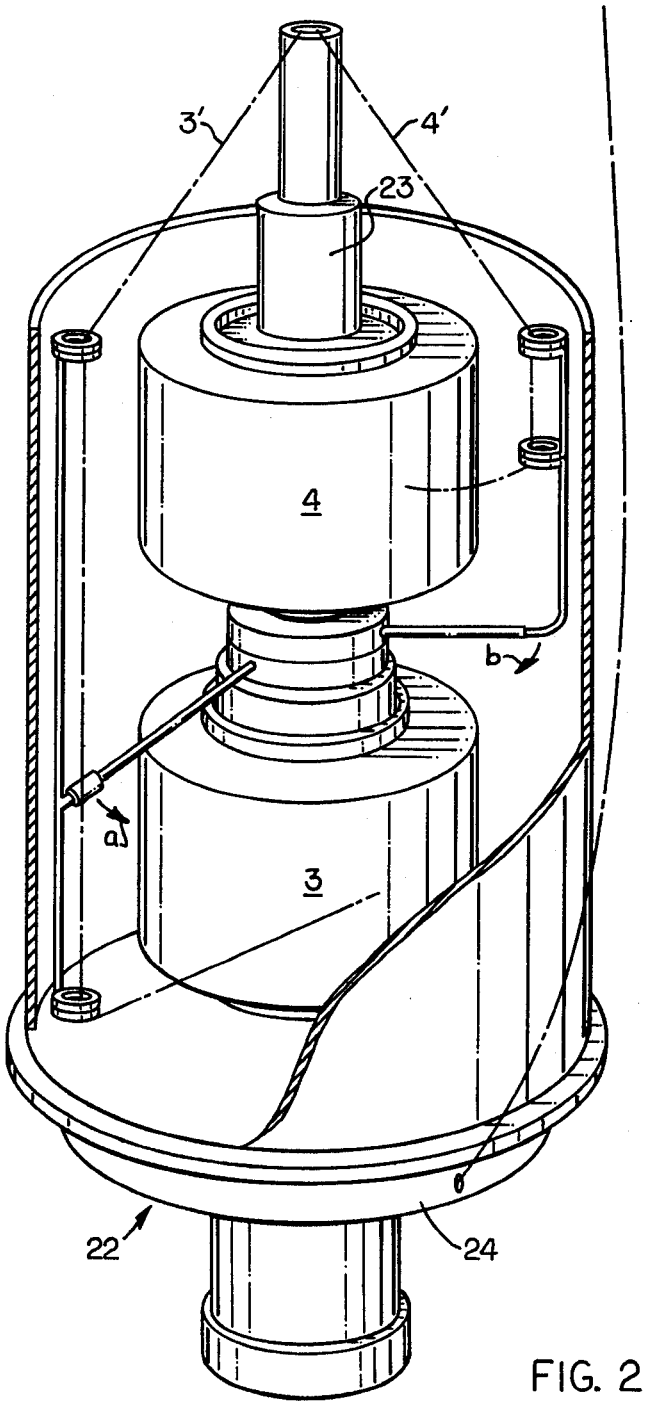
FIG. 2 is a diagrammatic illustration of a thread guide in accordance with the invention in the event of two individual threads being drawn off from two singly wound cross-wound bobbins disposed one above the other, in conjunction with a two-for-one twisting spindle.

FIG. 2 is a diagrammatic illustration of the correlation between the thread guide in accordance with the invention and a two-for-one twisting spindle 22 in which the two yarn bobbins 3 and 4 are slipped onto the hollow spindle 23 through which the two threads 3' and 4', drawn from the yarn bobbins 3 and 4, extend downwardly to emerge from the thread reserve disc 24 in a twisted state and are then guided upwardly as a ballon of yarn.

The thread guide illustrated in FIG. 2 corresponds to the thread guide illustrated in FIG. 1 and like parts are denoted by like reference numerals. Reference may therefore be made to the description of FIG. 1 for an understanding of the thread guide shown in FIG. 2.

I claim:

1. A combination of two bobbins having yarns wound thereon mounted coaxially one above the other, a thread guide flyer arrangement for drawing yarns off each of said bobbins, bearing bushing mountings for said thread guide flyer arrangement being located between said bobbins, said thread guide flyer arrangement being mounted on said bearing bushing mountings and said bearing bushing mountings consist of two bearing bushing mountings in sliding frictional contact with each other.

2. A combination as claimed in claim 1, said thread guide flyer arrangement having a first thread guide flyer for the lower coaxial bobbin being mounted between said two bobbins, and a second thread guide flyer of said thread guide flyer arrangement associated with the upper coaxial bobbin and also being mounted between said two bobbins.

3. A combination as claimed in claim 1, said bearing bushing mountings comprise bearing rings in sliding frictional contact with one another.

4. A combination as claimed in claim 1, said bearing bushing mountings are inserted one within the other and are in sliding frictional contact with one another.

5. A combination as claimed in claim 1, said bearing bushing mountings comprise cylindrical sleeves, each having annular flanges thereon, said cylindrical sleeves being inserted one within the other.

6. A combination as claimed in claim 1, said thread guide flyer arrangement has a substantially radially directed thread guide flyer arm and an outer end, an axially directed thread guide flyer bar connected to said outer end of said thread guide flyer arm, said outer end of said thread guide flyer arm having at least one thread-guide eye.

7. A combination as claim in claim 6, each thread guide flyer arrangement has a first thread-guide eye disposed in the region of the periphery of one bobbin, and a second thread-guide eye located in the region of the other bobbin.

* * * * *